US005261712A

United States Patent [19]

Walter

[11] Patent Number: 5,261,712

[45] Date of Patent: Nov. 16, 1993

[54] LATCH MECHANISM FOR AN ACCESS DOOR

[75] Inventor: Bernhard Walter, Neckarhausen, Fed. Rep. of Germany

[73] Assignee: Deere & Company, Moline, Ill.

[21] Appl. No.: 935,959

[22] Filed: Aug. 26, 1992

[30] Foreign Application Priority Data

Aug. 28, 1991 [DE] Fed. Rep. of Germany ..... 4128486

[51] Int. Cl.[5] ..... E05C 3/14

[52] U.S. Cl. ..... 292/228; 292/DIG. 63

[58] Field of Search ..... 292/121, 128, 219, 228, 292/DIG. 63

[56] References Cited

U.S. PATENT DOCUMENTS

| | | | |
|---|---|---|---|
| 37,625 | 2/1863 | Hyde | 292/121 |
| 192,919 | 7/1877 | Hoyt . | |
| 922,975 | 5/1909 | Todt | 292/128 |
| 939,480 | 11/1909 | Deggim . | |
| 1,128,550 | 2/1915 | Thompson | 292/128 X |
| 1,265,304 | 5/1918 | Davidson . | |
| 1,734,555 | 11/1929 | Bennett . | |
| 1,823,104 | 9/1931 | Johnson | 292/228 |
| 2,236,722 | 4/1941 | Wing . | |
| 2,376,066 | 5/1945 | Lamach | 292/304 |
| 2,667,058 | 1/1954 | Skoglund | 292/128 X |
| 2,790,688 | 4/1956 | Shepherdson . | |
| 3,003,800 | 10/1961 | Hammond | 292/128 X |
| 3,208,781 | 9/1965 | Appleberry | 292/128 |
| 3,225,363 | 12/1965 | Kirsch | 292/128 X |
| 3,266,830 | 8/1966 | Appleberry | 292/128 |
| 4,324,189 | 4/1982 | Roldness | 292/121 X |

*Primary Examiner*—Peter M. Cuomo
*Assistant Examiner*—Michael Milano

[57] ABSTRACT

A latch mechanism attaches an access door to a frame. The frame has a horizontally extending ledge with an opening formed therein. A pin is rigidly attached to the frame spaced apart from the opening. A latch opening is formed in the access door. A lever is pivotally mounted on the pin and has an end which integrally forms a wedge-shaped latch member, and a part of the lever engages the frame to form a pivot axis about which the lever pivots. A spring is mounted on the pin and is biassed to hold the lever in a position wherein the latch member is received by the latch opening when the door is in a closed position. The lever is comprised of a flat metal strip including a bent portion which pivotally engages the frame and includes a first section which extends between the latch member and the pivot axis. The lever includes a second section which is positioned on the other side of the pivot axis and which is normally spaced apart from the frame. The latch member extends through the opening in the frame and into the latch opening in a closed position of the latch mechanism. The latch member remains at least partially received by the opening in the frame at all times, and the latch opening of the access door is located in a bracket attached to the access door.

11 Claims, 1 Drawing Sheet

LATCH MECHANISM FOR AN ACCESS DOOR

BACKGROUND OF THE INVENTION

The invention relates to a latch mechanism for releasably holding an access door or an enclosure panel to a frame on a vehicle.

Latch mechanisms are well known and are used, for example, in house doors. Such latch mechanisms are actuated by a door handle and have relatively complicated mechanisms. For reasons of functional capability and cost these latch mechanisms are usually not appropriate for vehicle construction.

Typically, vehicles are made with service or maintenance doors which require the use of tools. Closing of such doors may require additional manual operations, such as inserting a pin, rotating a retaining lever, tightening a screw, or lifting a snap closure or the like.

SUMMARY OF THE INVENTION

Accordingly, an object of this invention is to provide a latch mechanism which is simple and safe to operate and can be manufactured at low cost and is appropriate for application to vehicle manufacture, in particular to agricultural tractors or other utility or agricultural vehicles.

This and other objects are achieved by the latch mechanism of the present invention which releasably attaches an access door to a frame. The latch mechanism includes a latch opening formed by a bracket which is attached to the access door. The frame includes a shelf which forms a shelf opening which can be in alignment with the latch opening. A lever is mounted on the shelf and is pivotal about a part of the lever. An end of the lever forms a wedge-shaped latch member. A spring is coupled between the lever and the frame and is biassed to hold the lever in a position wherein the latch member extends through the shelf opening and is received by the latch opening when the latch mechanism is closed.

DETAILED DESCRIPTION

Figure 1:
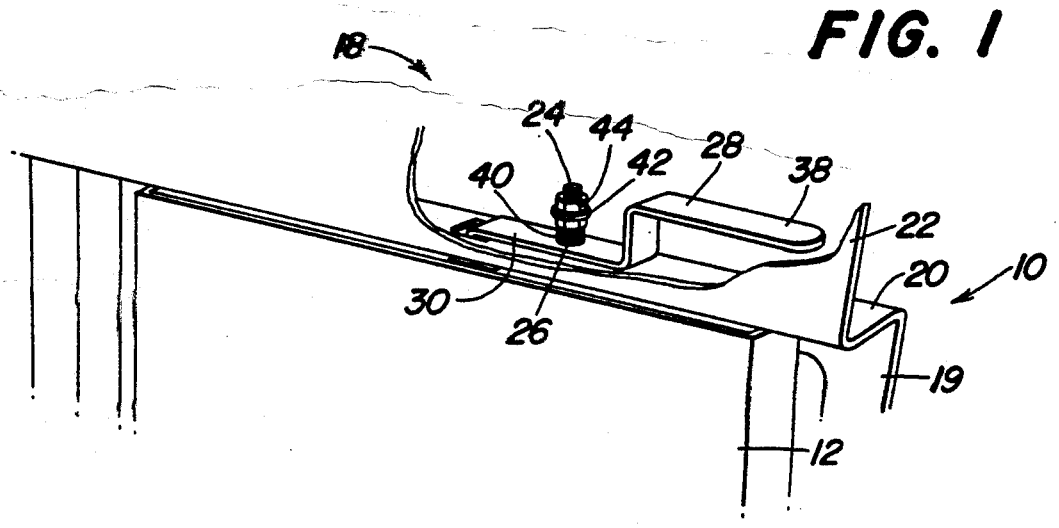
FIGS. 1 through 3 show a perspective view of a section of an enclosure component pivoted from a support frame with a latch mechanism according to the invention in closed and in open position as well as during the closing process.
Figure 2:
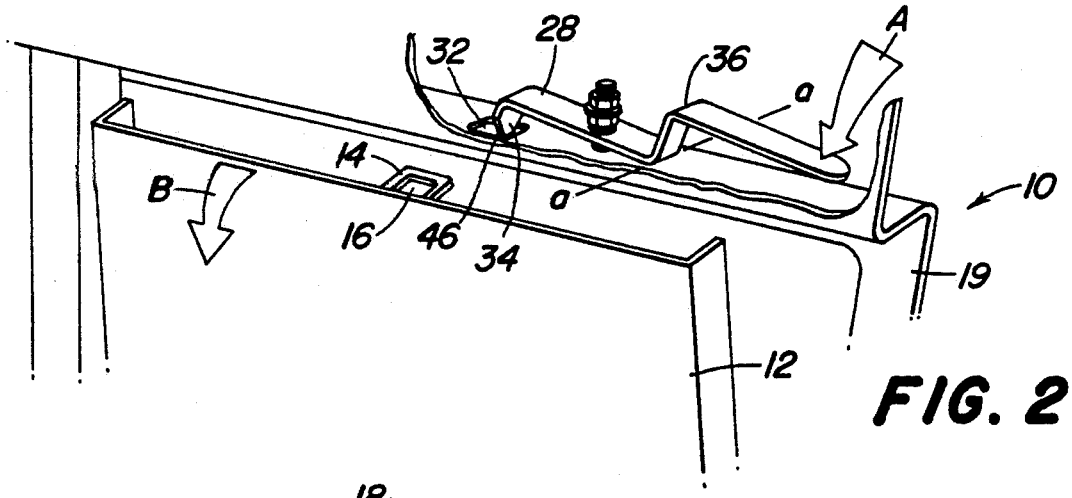
Figure 3:
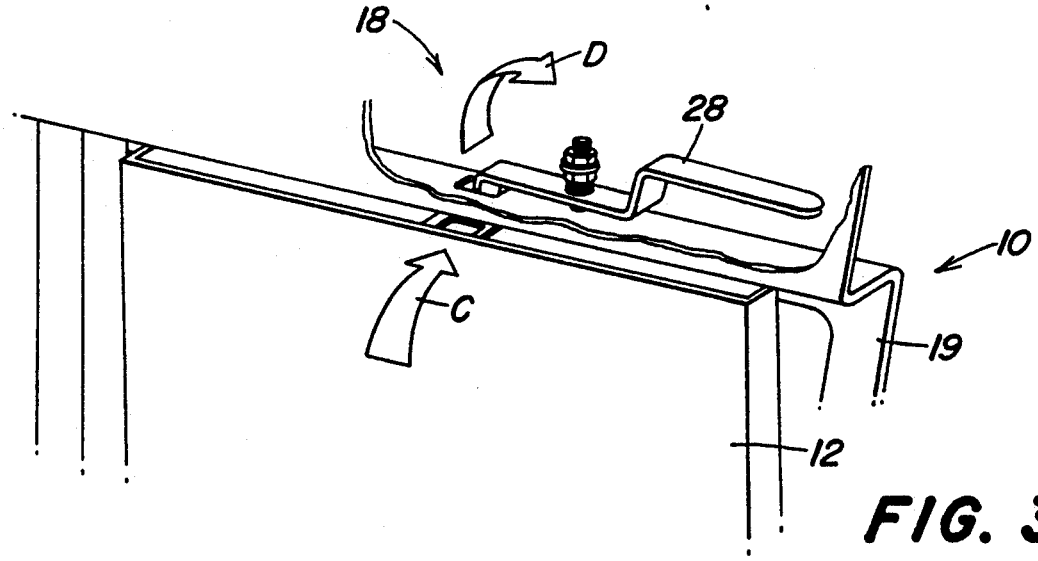

Referring to FIGS. 1-3, the support frame 10 is attached along one side of an engine (not shown) of an agricultural tractor (not shown). An access, or service or maintenance door 12 is attached to the frame 10 by a hinge, (not shown) and can be pivoted about the hinge axis and opened. Alternatively, the door 12 could have a lower side which is attached to the support frame 10 by a plug-in connection (not shown). A latch mechanism 18 releasably holds the door 12 to the frame 10.

The support frame 10 has a lower wall 19 and an upper wall 22 joined together by a horizontal shelf or step 20. The door 12 is attached to the frame 10 below the shelf 20. The shelf 20 is flat with a top surface facing away from the access door and a bottom surface facing towards the access door 12. A portion of the upper wall 22 is removed from the drawings so as to show the latch mechanism 18. A vertically upwardly extending threaded pin 24 is attached to the shelf 20, for example by welding. A rectangular opening 32 extends through a middle portion of the shelf 20.

A catch bracket 14 is attached to the upper central region of the door 12. The bracket 14 forms a generally rectangular opening 16 which is aligned with the opening 32 in the shelf 20.

The latch mechanism 18 includes a lever 28 which is formed out of a steel strip bent into a plurality of sections. The lever 28 has a first section 30 which contains an opening 26 through which extends threaded pin 24. An end extends downwardly from an end of the first section 30 and forms a catch hook or latch 34. As best seen in FIG. 2, the free end of the latch 34 is wedge-shaped and tapers in the direction facing the door 12 and forms a ramp surface 46 which is engagable with the bracket 14. The lever 28 includes a second section 38 which extends generally parallel to the shelf 20 and which is joined to the first section 30 by a generally vertically extending third section 36. Section 38 forms a handle which may be used for manual actuation during opening of the door 12. The lower edge of the third section 36 is supported on the surface of the shelf 20 which faces away from the door and forms a pivot about which the lever 28 can be pivoted. The shelf 20 is positioned between the door 12 and all portions of the lever 28 other than the latch 34. Preferably, the hole 26 in the lever 28 is somewhat longer in its longitudinal dimension than in the transverse direction of the lever 28, so as to facilitate pivoting of lever 28 about the lower edge of section 36, while providing a small clearance with respect to the pin 24.

A helical compression spring 40 is mounted on the threaded pin 24 and is secured by a plain washer 42 and a nut 44. The spring 40 engages the side of the lever 28 which faces away from the shelf 20. The spring 40 normally holds the lever 28 in the position shown in FIG. 1 with section 30 flat against the shelf 20.

MODE OF OPERATION

In FIG. 1 the latch mechanism 18 is closed. Section 30 of lever 28 is held against the shelf 20 by the spring 40. The latch 34 extends through the opening 26 in the shelf 20 and into the opening 16 in the bracket 14 and holds the door 12 closed.

FIG. 2 illustrates the opening of the latch mechanism 18. As indicated by the arrow A, the operator depresses section 38 of the lever 28. This pivots lever 28 about the lower edge of section 36 which is supported on the shelf 20. This withdraws latch 34 from the opening 16 in the bracket 14 and frees the door 12, which now can be pivoted in the direction of the arrow B. When section 38 of the lever 28 is depressed, section 30 pivots about the lower edge of section 36 and compresses spring 40. If the section 38 is depressed completely, its end engages the shelf 20 as is illustrated in FIG. 2. In this position the latch 34 is removed from opening 16 of the door 12, so that the door 12 can be opened, but remains partly received by the opening 32 of the shelf 20. This prevents the lever 28 from being rotated about the threaded pin 24 in its open position.

As best seen in FIG. 3, the door 12 is closed by moving it in the direction of the arrow C. As already noted above, the catch bracket 14 moves against the ramp 46 of the latch 34 and presses the latch 34 upward against the force of the spring 40. If, during the closing of the door 12, the bracket 14 engages the ramp surface 46, the latch 34 will be moved upward, thus pivoting the lever 28 against the force of the spring 40. This was indicated by the arrow D. As the door 12 is closed further, the latch 34 automatically engages the opening 16 of the catch bracket 14 and locks the door 12.

To close the access door it need only be pressed against the frame by hand. Thereby the latch is initially automatically reset before it locks, without requiring any tools or the need for any other manual operations. By the locking of the latch the access door is safely retained in its closed position. The latch mechanism according to the invention, keeps the latch closed reliably despite any shocks. To open the access door it is enough to simply apply pressure to the detent lever.

The latch mechanism is simple and operator-friendly, can be manufactured at low cost and applicable to frequently used plug-in connected or pivoted enclosure components as well as other service and maintenance doors used to cover vehicle components such as engines.

Preferably the latch is integrated with the detent lever and configured, for example, as an angled section of the detent lever. The detent lever, in particular, may consist of a flat strip of material which is bent at an angle in at least one area transverse to its longitudinal direction. Thereby the edge of the flat strip created by the angled bend is supported against the frame and forms the transverse axis about which the detent lever can be pivoted. The flat strip can appropriately be a steel strip with angled bends.

The end of the compression spring opposite the detent lever may also be retained by a cotter pin, a roll pin, a retaining washer, a retaining ring, a bayonet clip or the like.

Most appropriately the detent lever contains an elongated hole in the section between the latch and the transverse axis, which engages the pin. Here the longitudinal axis of the elongated hole lies in the longitudinal direction of the lever at right angles to the transverse axis. The width of the elongated hole corresponds approximately to the diameter of the pin with a small side clearance. The length of the elongated hole is selected so that a pivoting of the detent lever about the transverse axis is possible, resulting in an inclination relative to the pin.

In order that the latch can absorb the forces applied to it during closing and in the closed position, it preferably extends through an opening in the frame and engages the opening in the access door in the closed position. Therefore the latch can be supported by the side edges of the opening in the frame located in the closing direction. The free end of the latch ends preferably in an inclined ramp facing the access door, along which the access door can slide during closing and move the detent lever into the open position. If the access door is completely closed the latch automatically rebounds elastically and enters the opening in the access door provided for the closed position.

In order to prevent a rotation of the detent lever about the axis of the spring arrangement in the open position, a limitation of the actuation path of the detent lever is provided so that the free end of the latch extending through an opening in the housing remains at least partly engaged in this opening at all times, that is, also during the opening of the latch mechanism.

According to an advantageous further development of the invention the opening of the access door is located on a catch bracket integrated with the access door. The catch bracket may be configured, for example, as a sheet metal bracket bolted to the access door or an integral part of a plastic access door.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A latch mechanism releasably attaching an access door to a frame, characterized by:

the frame having a flat shelf with top surface facing away from the access door and a bottom surface facing towards the access door, the shelf having a latch aperture formed therein, a latch opening formed by the access door;

a lever pivotally mounted on the top surface of the shelf, an end of the lever forming a wedge-shaped latch member, a part of the lever engaging the top surface of the shelf to form a pivot axis about which the lever pivots, the pivot axis extending transversely to a longitudinal axis of the lever; and a spring coupled between the lever and the shelf, the spring being biased to hold the lever in a position wherein the latch member is received by the latch aperture and by the latch opening when the latch mechanism is in a closed position, the lever including a first section which extends between the latch member and the pivot axis and which is held against the shelf by the spring, the lever also including a second section which is normally spaced apart from the shelf, the pivot axis being positioned between the first and second sections.

2. The latch mechanism of claim 1, wherein:

the latch member is formed integrally by an end of the lever.

3. The latch mechanism of claim 1, wherein:

the lever is comprised of a flat metal strip including a bent portion, a surface of the bent portion being in pivotal engagement with the frame.

4. The latch mechanism of claim 1, wherein:

the shelf is positioned between the door and all portions of the lever other than the latch member.

5. The latch mechanism of claim 1, wherein:

the latch member remains at least partially received by the aperture in the shelf at all times.

6. The latch mechanism of claim 1, wherein:

the latch opening of the access door is located in a bracket attached to the access door.

7. A latch mechanism releasably attaching an access door to a frame, characterized by:

the frame having a flat shelf with top surface facing away from the access door and a bottom surface facing towards the access door, the shelf having a latch aperture formed therein, a latch opening formed by the access door;

a lever pivotally mounted on the top surface of the shelf, an end of the lever forming a wedge-shaped latch member, a part of the lever engaging the top surface of the shelf to form a pivot axis about which the lever pivots, the pivot axis extending transversely to a longitudinal axis of the lever;

a spring coupled between the lever and the shelf, the spring being biased to hold the lever in a position wherein the latch member is received by the latch aperture and by the latch opening when the latch mechanism is in a closed position;

a pin rigidly attached to the shelf, the lever having a opening which receives the pin, the spring being mounted on the pin and engaging a side of the lever which faces away from the shelf.

8. The latch mechanism of claim 7, wherein:

The shelf is positioned between the door and all portions of the lever other than the latch member.

9. The latch mechanism of claim 7, wherein:

the latch member remains at least partially received by the aperture in the shelf at all times.

10. The latch mechanism of claim 7, wherein:

the latch opening of the access door is located in a bracket attached to the access door.

11. A latch mechanism releasably attaching an access door to a frame, characterized by:

the frame having a flat shelf with top surface facing away from the access door and a bottom surface facing towards the access door, the shelf having a latch aperture formed therein, a latch opening formed by the access door;

a lever pivotally mounted on the top surface of the shelf, an end of the lever forming a wedge-shaped latch member, a part of the lever engaging the top surface of the shelf to form a pivot axis about which the lever pivots, the pivot axis extending transversely to a longitudinally axis of the lever; and a spring having a first end coupled to the shelf and a second end engaging a section of the lever, said section of the lever being positioned between the shelf and said second end of the spring, the spring having a length which is variable in a direction which is perpendicular to the top surface of the shelf, the spring being biased to hold the lever in a position wherein the latch member is received by the latch aperture and by the latch opening when the latch mechanism is in a closed position.

* * * * *